US009697970B1

(12) United States Patent
I

(10) Patent No.: US 9,697,970 B1
(45) Date of Patent: Jul. 4, 2017

(54) PROTECTIVE STRUCTURE, SOCKET, PLUG AND METHOD ASSURING A LIVE WIRE AND A NEUTRAL WIRE TO BE POWERED OFF SIMULTANEOUSLY WHEN OVERHEATING

(71) Applicant: Green Idea Tech Inc., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

(21) Appl. No.: 15/233,131

(22) Filed: Aug. 10, 2016

(51) Int. Cl.

| | |
|---|---|
| ***H01R 13/68*** | (2011.01) |
| ***H01H 37/76*** | (2006.01) |
| ***H01R 13/713*** | (2006.01) |
| ***H01H 37/32*** | (2006.01) |
| *H01T 1/14* | (2006.01) |
| *H01T 4/06* | (2006.01) |
| *H01H 37/00* | (2006.01) |
| *G08B 17/06* | (2006.01) |

(52) U.S. Cl.
CPC ..... *H01H 37/76* (2013.01); *H01H 37/32* (2013.01); *H01R 13/7137* (2013.01); *G08B 17/06* (2013.01); *H01H 37/002* (2013.01); *H01H 37/765* (2013.01); *H01T 1/14* (2013.01); *H01T 4/06* (2013.01)

(58) Field of Classification Search
None
See application file for complete search history.

(56) References Cited

U.S. PATENT DOCUMENTS

| | | | | |
|---|---|---|---|---|
| 6,132,257 | A * | 10/2000 | Wang | H01R 13/641 337/142 |
| 6,166,618 | A * | 12/2000 | Robertson | H01H 37/765 307/86 |
| 6,430,019 | B1 * | 8/2002 | Martenson | H01C 7/126 361/103 |
| 8,179,652 | B2 * | 5/2012 | Depping | H01C 7/126 361/103 |
| 9,257,798 | B2 | 2/2016 | Wang | |
| 9,484,683 | B1 * | 11/2016 | Wang | H01R 13/696 |
| 9,627,821 | B1 * | 4/2017 | I | H01R 13/68 |

FOREIGN PATENT DOCUMENTS

| | | |
|---|---|---|
| TW | M509999 | 10/2015 |

* cited by examiner

*Primary Examiner* — Tho D Ta
(74) *Attorney, Agent, or Firm* — Muncy, Geissler, Olds & Lowe, P.C.

(57) ABSTRACT

The present invention discloses a protective structure, plug, socket and method assuring a live wire and a neutral wire to be powered off simultaneously when overheating. The present invention limits a live wire spring plate from contacting with a live wire conductive plate, and a neutral wire spring plate from contacting with a neutral wire conductive plate, such that when the live wire spring plate and the live wire conductive plate are overheated or the neutral wire spring plate and the neutral wire conductive plate are overheated, the live wire spring plate, the live wire conductive plate, the neutral wire spring plate and the neutral wire conductive plate can be separated apart at a same time.

12 Claims, 20 Drawing Sheets

PROTECTIVE STRUCTURE, SOCKET, PLUG AND METHOD ASSURING A LIVE WIRE AND A NEUTRAL WIRE TO BE POWERED OFF SIMULTANEOUSLY WHEN OVERHEATING

BACKGROUND OF THE INVENTION a) Field of the Invention

The present invention relates to a protective structure, socket, plug and method assuring a live wire and a neutral wire to be powered off simultaneously when overheating, and more particularly to an invention wherein when a live wire spring plate and a live wire conductive plate are overheated or a neutral wire spring plate and a neutral wire conductive plate are overheated, the live wire spring plate, the live wire conductive plate, the neutral wire spring plate and the neutral wire conductive plate are assured to be separated apart at a same time.

b) Description of the Prior Art

To prevent a circuit from issues of current overload, short circuit and overheating, a fuse or an overload protector is usually provided at the circuit. When the temperature of the circuit gets too high or the current gets too large, the fuse affected by the high temperature becomes blown or a bi-metal shrapnel of the overload protector becomes disengaged, so as to cause the circuit become open circuit and turned off to ensure electricity safety.

The Taiwan Utility Model Patent M509999, "Overheating Destructive Insulative Fixing Plate as well as a Plug and a Socket Using that Insulative Fixing Plate," has disclosed an overheating destructive insulative fixing plate, which includes a connecting element and two limiting elements combined at two ends of the connecting element to form an H-shaped structure. The connecting element is put into the grooves formed on two conductive elements, enabling the two limiting elements to be abutted at an exterior side of the conductive element respectively and limiting the two conductive elements from contacting with each other. The connecting element is destructed when overheating, forming an open circuit between the two conductive elements.

However, each live wire spring plate and each live wire conductive plate will use an overheating destructive fixing plate, and each neutral wire spring plate and each neutral wire conductive plate will use another overheating destructive fixing plate, as shown in FIG. 21 of the abovementioned patent M509999. When a load (electric appliance) is connected between the live wire conductive plate and the neutral wire conductive plate, the electric current will flow through the live wire spring plate, the live wire conductive plate, the load (electric appliance), the neutral wire conductive plate and the neutral wire spring plate orderly to form an open path. If the location of overheating is between the neutral wire spring plate and the neutral wire conductive plate, then the fixing plate between the neutral wire spring plate and the neutral wire conductive plate will be destructed due to overheating. At this time, the fixing plate between the live wire spring plate and the live wire conductive plate may not be destructed. Therefore, the high electric current can still enter into the load prior to forming an open circuit; whereas, if electricity leaks out of the load and an operator touches the load under grounding, then the operator may get an electric shock.

Furthermore, in the embodiment shown in FIG. 1, FIG. 2 and FIG. 3 of the U.S. Pat. No. 9,257,798, a limiting element is used independently between the live wire conductive plate and the live wire contact portion, and another limiting element is also used independently between the neutral wire conductive plate and the neutral wire contact portion. Accordingly, that U.S. Pat. No. 9,257,798 is also provided with the same issue as the abovementioned Taiwan Utility Model Patent M509999. In other words, under overheating, in the structure disclosed in the U.S. Pat. No. 9,257,798, it is possible that only the limiting element between the neutral wire conductive plate and the neutral wire contact portion is destructed, but the limiting element between the live wire conductive plate and the live wire contact portion remains intact.

SUMMARY OF THE INVENTION

Accordingly, to assure that the live wire spring plate and the live wire conductive plate located before the load can be tripped off actually when the electric circuit is overheated, the present invention discloses a protective structure which assures the live wire and the neutral wire to be powered off simultaneously when overheating. The protective structure that assures the live wire and the neutral wire to be powered off simultaneously when overheating is used to limit the live wire spring plate and the live wire conductive plate from contacting with each other, as well as to limit the neutral wire spring plate and the neutral wire conductive plate from contacting with each other.

The protective structure that assures the live wire and the neutral wire to be powered off simultaneously when overheating includes a first limiting element, a second limiting element and a connecting element. The connecting element is connected with the first limiting element and the second limiting element. The first limiting element and the second limiting element abut respectively at the live wire spring plate and the neutral wire spring plate, and the connecting element is used to limit the live wire spring plate and the neutral wire spring plate, such that the live wire spring plate and the live wire conductive plate can contact with each other, as well as the neutral wire spring plate and the neutral wire conductive plate can contact with each other. When a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element will all lose the original limiting function thereof, allowing the live wire spring plate, the live wire conductive plate, the neutral wire spring plate and the neutral wire conductive plate to be separated apart at a same time.

Furthermore, the first limiting element, the second limiting element and the connecting element are all made of plastic, the first limiting element and the second limiting element are in a shape of plates, a destructive portion is disposed between the connecting element and the first limiting element, as well as between the connecting element and the second limiting element, and the thickness of the destructive portion is smaller than the thickness of the connecting element.

Furthermore, the first limiting element and the second limiting element are made of metal, and the connecting element is made of plastic. A destructive portion is disposed between the connecting element and the first limiting element, as well as between the connecting element and the second limiting element.

Furthermore, the first limiting element and the second limiting element are all in a shape of bumps which are formed respectively at two opposite ends of the connecting element.

Furthermore, the live wire conductive plate is formed with a first notch, the live wire spring plate is formed with a second notch, the neutral wire conductive plate is formed with a third notch, and the neutral wire spring plate is formed with a fourth notch. The first notch, the second notch, the third notch and the fourth notch are used to accommodate the connecting element, wherein the width of the first notch is larger than the width of the second notch, and the width of the third notch is larger than the width of the fourth notch.

Furthermore, the first limiting element is formed with a first collar to sheath the live wire spring plate and the second limiting element is formed with a second collar to sheath the neutral wire spring plate. Moreover, part of the wall of the first collar is thinner to form a first destructive portion, and part of the wall of the second collar is thinner to form a second destructive portion.

Furthermore, the live wire spring plate is formed with a first bending portion on which is provided with a first groove, so as to form a first sheathing section on the first bending portion, allowing the first collar to be sheathed on the first sheathing section. The neutral wire spring plate is formed with a second bending portion on which is provided with a second groove, so as to form a second sheathing section on the second bending portion, allowing the second collar to be sheathed on the second sheathing section.

Furthermore, the live wire conductive plate includes plural live wire slots and contacts with one single live wire spring plate. The neutral wire conductive plate includes plural neutral wire slots and contacts with one single neutral wire spring plate. Under a normal condition, the live wire conductive plate, the live wire spring plate, the neutral wire conductive plate and the neutral wire spring plate are commonly limited by the first limiting element, the second limiting element and the connecting element.

The present invention also discloses a socket which uses the abovementioned protective structure assuring the live wire and the neutral wire to be powered off simultaneously when overheating. The socket includes an insulative unit, a live wire conductive plate, a neutral wire conductive plate, a live wire spring plate and a neutral wire spring plate. The insulative unit is provided at least with a live wire receptacle and an opposite neutral wire receptacle. The live wire conductive plate is installed in the insulative unit and corresponds to the live wire receptacle. The neutral wire conductive plate is installed in the insulative unit and corresponds to the neutral wire receptacle. The live wire spring plate is installed in the insulative unit and corresponds to the live wire conductive plate. The neutral wire spring plate is installed in the insulative unit and corresponds to the neutral wire conductive plate. By abutting the first limiting element and the second limiting element of the protective structure, which assures the live wire and the neutral wire to be powered off simultaneously when overheating, at the live wire spring plate and the neutral wire spring plate respectively, and by using the connecting element to limit the live wire spring plate and the neutral wire spring plate, the live wire spring plate and the live wire conductive plate will contact with each other, as well as the neutral wire spring plate and the neutral wire conductive plate will contact with each other. In addition, when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element will all lose the original limiting function thereof, allowing the live wire spring plate, the live wire conductive plate, the neutral wire spring plate and the neutral wire conductive plate to be separated apart at a same time.

The present invention also discloses a plug which uses the abovementioned protective structure assuring the live wire and the neutral wire to be powered off simultaneously when overheating. The plug includes an insulative unit, a live wire conductive plate, a neutral wire conductive plate, a live wire spring plate and a neutral wire spring plate. The live wire conductive plate is disposed in the insulative unit and is extended out of the insulative unit. The neutral wire conductive plate is disposed in the insulative unit and is extended out of the insulative unit. The live wire spring plate is disposed in the insulative unit and corresponds to the live wire conductive plate. The neutral wire spring plate is disposed in the insulative unit and corresponds to the neutral wire conductive plate. By abutting the first limiting element and the second limiting element of the protective structure, which assures the live wire and the neutral wire to be powered off simultaneously when overheating, at the live wire spring plate and the neutral wire spring plate respectively, and by using the connecting element to limit the live wire spring plate and the neutral wire spring plate, the live wire spring plate and the live wire conductive plate will contact with each other, as well as the neutral wire spring plate and the neutral wire conductive plate will contact with each other. In addition, when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element will all lose the original limiting function thereof, allowing the live wire spring plate, the live wire conductive plate, the neutral wire spring plate and the neutral wire conductive plate to be separated apart at a same time.

The present invention also discloses a method which assures the live wire and the neutral wire to be powered off simultaneously when overheating. The method includes abutting the first limiting element and the second limiting element at the live wire spring plate and the neutral wire spring plate respectively, and using the connecting element to connect with the first limiting element and the second limiting element, allowing the connecting element to limit the live wire spring plate and the neutral wire spring plate, so that under a normal condition, the live wire spring plate and the live wire conductive plate can contact with each other, as well as the neutral wire spring plate and the neutral wire conductive plate can contact with each other; and selecting a thermal destructive material for the first limiting element, the second limiting element or the connecting element, with that the thermal destructive material is allowed to be destructed at a temperature of 80° C.-299° C., so that when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element will all lose the original limiting function thereof, allowing the live wire spring plate, the live wire conductive plate, the neutral wire spring plate and the neutral wire conductive plate to be separated apart at a same time.

The benefits of the present invention lie in that:

1. When an open path is overheated, the live wire spring plate, the live wire conductive plate, the neutral wire spring plate and the neutral wire conductive plate can be assured to be tripped off at a same time, so that the load (electric appliance) will not receive the electric current any more.
2. By forming a bending portion on the live wire spring plate and the neutral wire spring plate respectively, the relative position of the bending portion on the live wire spring plate and the neutral wire spring plate will be fixed. Therefore, only one size is needed for the protective structure assuring the live wire and the neutral wire to be powered off simultaneously when overheating to apply to various plugs or sockets.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

According to the abovementioned technical features, the primary benefits of the protective structure, plug, socket and method assuring the live wire and the neutral wire to be powered off simultaneously when overheating can be clearly disclosed in the following embodiments.

Figure 1:
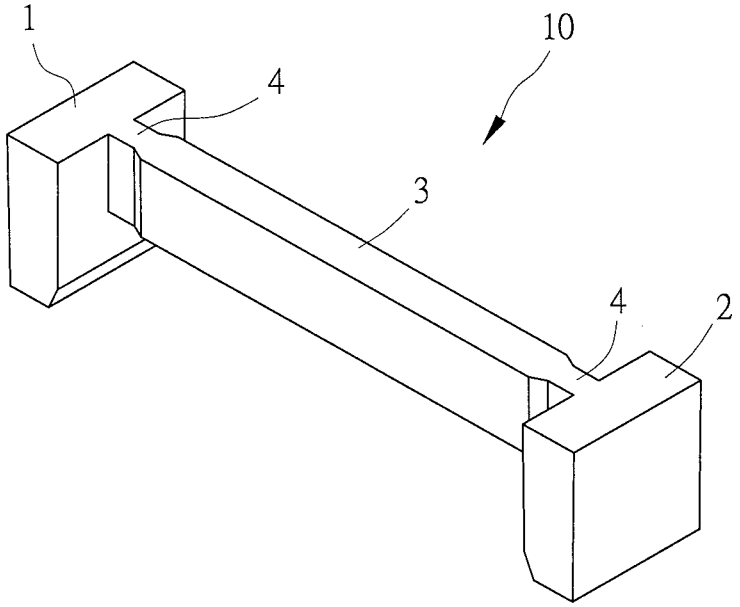
FIG. 1 shows a three-dimensional view of appearance of a protective structure assuring a live wire and a neutral wire to be powered off simultaneously when overheating, according to a first embodiment of the present invention.
Figure 2:
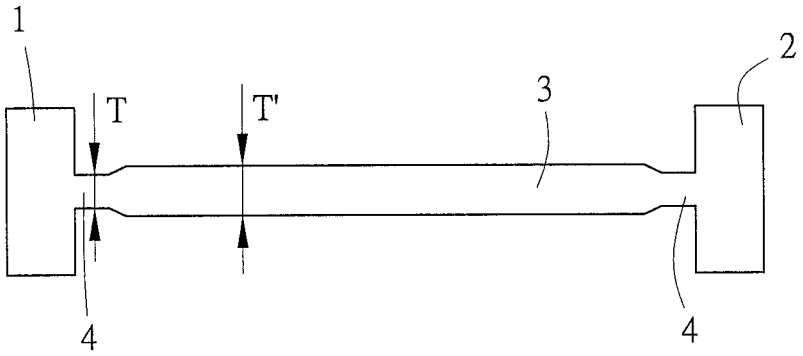
FIG. 2 is a top view of FIG. 1.

Referring to FIG. 1 and FIG. 2 for the first embodiment of the present invention, the protective structure 10 assuring the live wire and the neutral wire to be powered off simultaneously when overheating, according to the present embodiment, comprises a first limiting element 1, a second limiting element 2 and a connecting element 3. The connecting element 3 is connected with the first limiting element 1 and the second limiting element 2, forming an H-shaped structure to the protective structure 10 that assures the live wire and the neutral wire to be powered off simultaneously when overheating. The first limiting element 1, the second limiting element 2 and the connecting element 3 are selectively made of a thermal destructive material, such as plastic. The thermal destructive material is allowed to be destructed at a temperature of 80° C.-299° C., and the first limiting element 1 and the second limiting element 2 are in a plate shape. A destructive portion 4 is disposed between the connecting element 3 and the first limiting element 1 as well as between the connecting element 3 and the second limiting element 2. In addition, the width T of the destructive portion 4 is smaller than the width T' of the connecting element 3.

Figure 3:
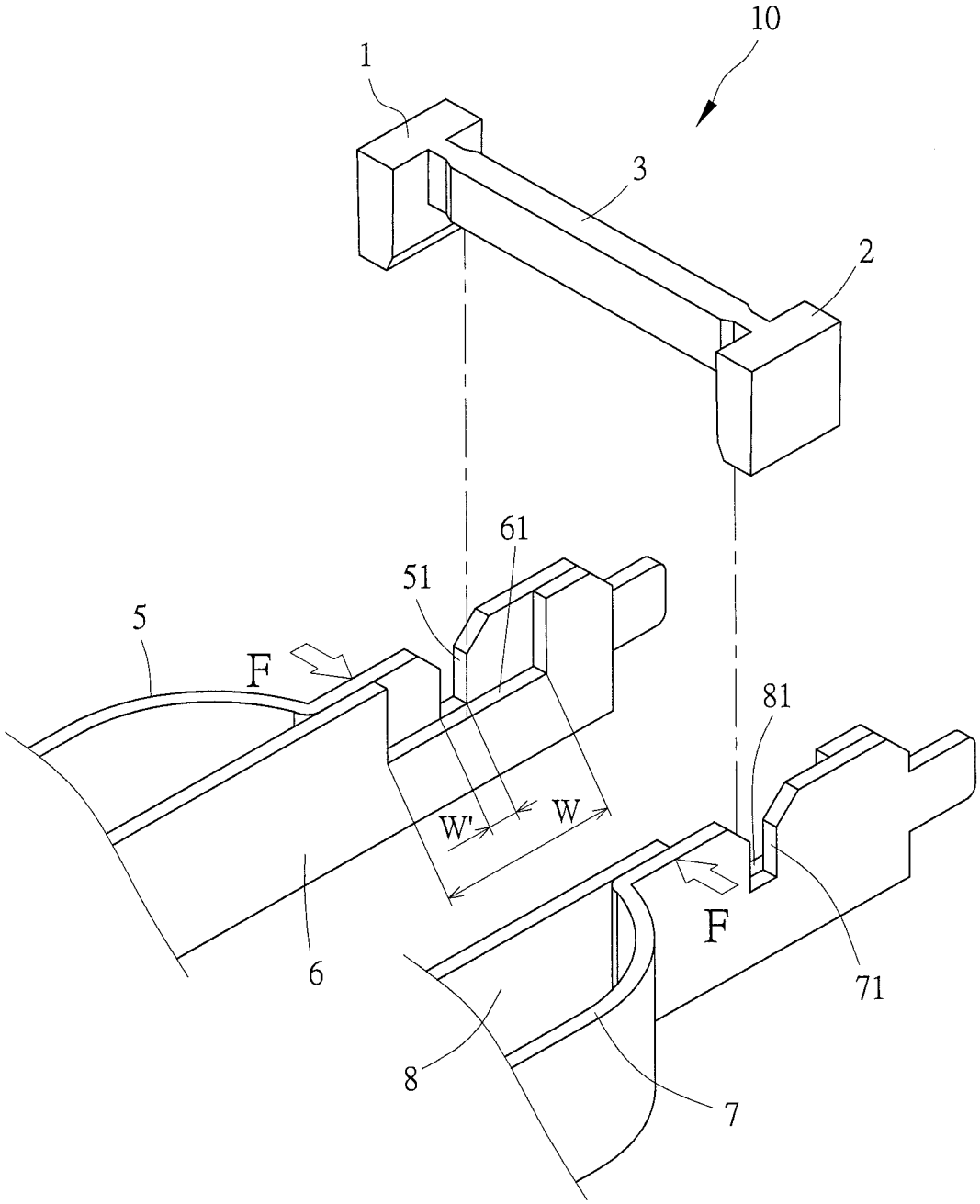
FIG. 3 shows an exploded view of combining the protective structure assuring a live wire and a neutral wire to be powered off simultaneously when overheating with a live wire spring plate and a neutral wire spring plate, according to the first embodiment of the present invention.
Figure 3A:
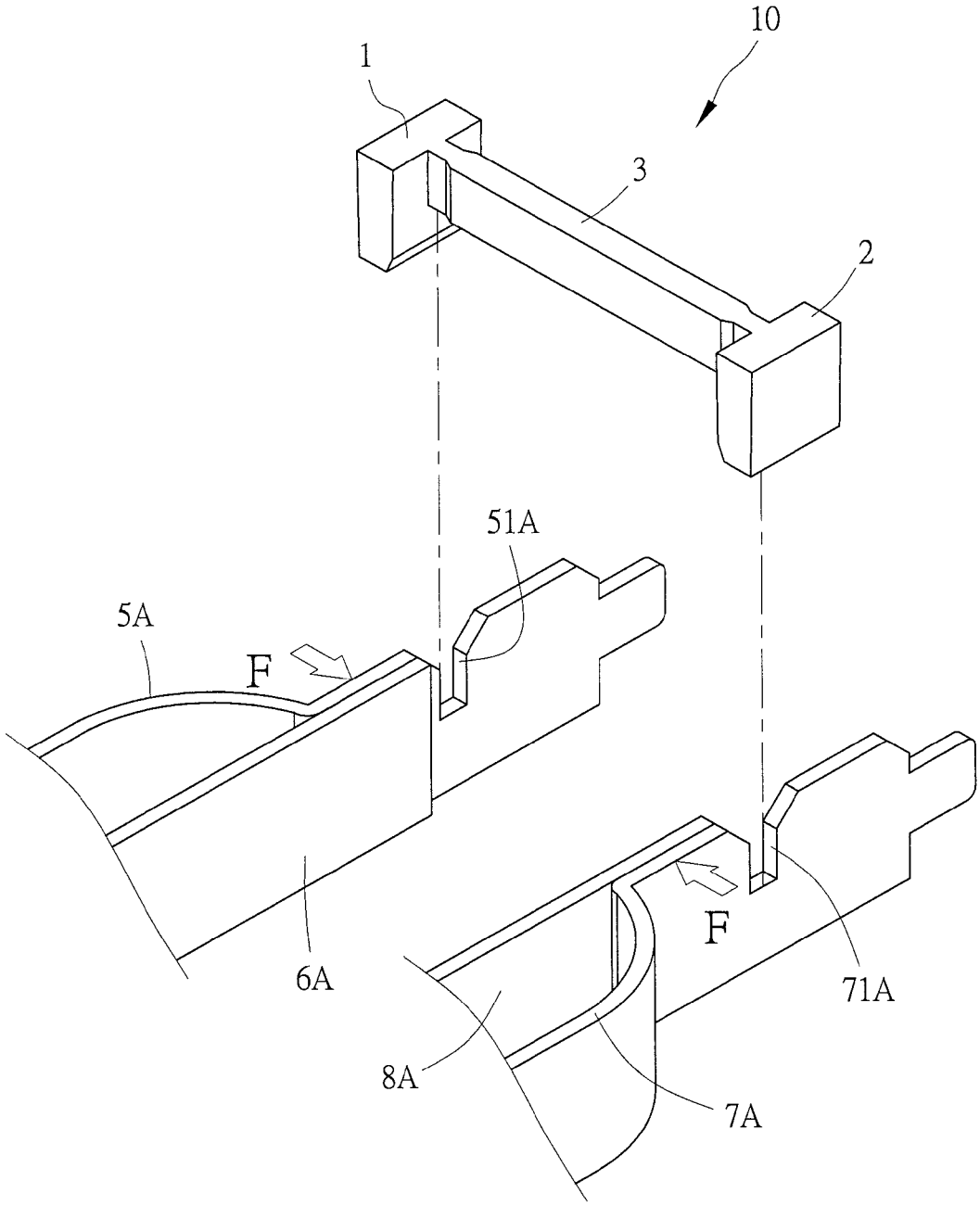
FIG. 3A shows a schematic view of an example of variation in a live wire conductive plate and a neutral wire conductive plate, according to the first embodiment of the present invention.
Figure 4:
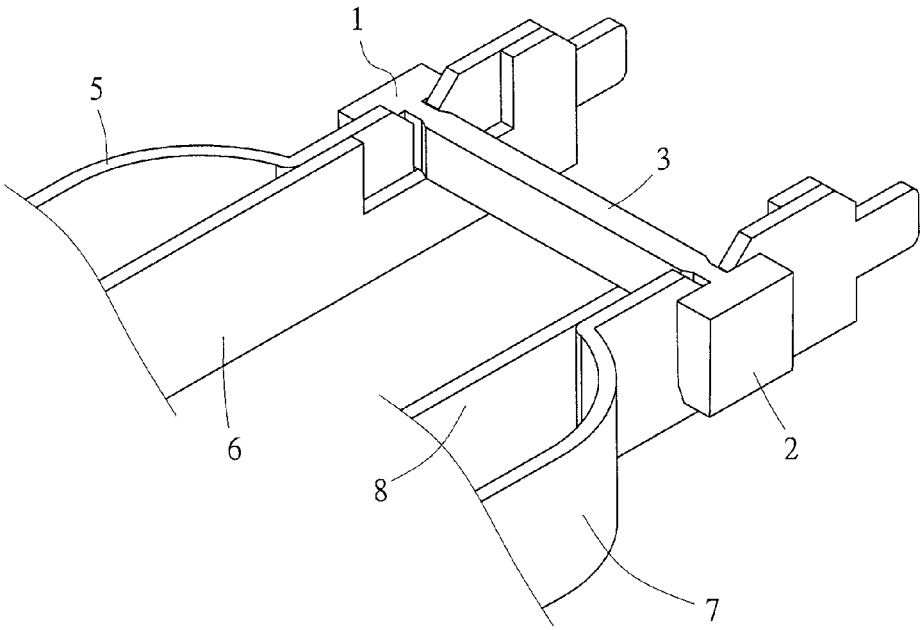
FIG. 4 shows a schematic view of combining the protective structure assuring a live wire and a neutral wire to be powered off simultaneously when overheating with the live wire spring plate and the neutral wire spring plate, according to the first embodiment of the present invention.

Referring to FIG. 3 and FIG. 4, the protective structure 10 that assures the live wire and the neutral wire to be powered off simultaneously when overheating is used to limit a live wire spring plate 5 and a live wire conductive plate 6 from contacting with each other, as well as a neutral wire spring plate 7 and a neutral wire conductive plate 8 from contacting with each other. The live wire conductive plate 6 is formed with a first notch 61, the live wire spring plate 5 is formed with a second notch 51, the neutral wire conductive plate 8 is formed with a third notch 81, and the neutral wire spring plate 7 is formed with a fourth notch 71. In the present embodiment, the width W of the first notch 61 is larger than the width W' of the second notch 51, and the width W of the third notch 81 is larger than the width W' of the fourth notch 71. An external force F is applied first to abut the live wire spring plate 5 at the live wire conductive plate 6, and to abut the neutral wire spring plate 7 at the neutral wire conductive plate 8. Next, the first limiting element 1 and the second limiting element 2 abut respectively at the live wire spring plate 5 and the neutral wire spring plate 7, and the connecting element 3 is accommodated in the first notch 61, the second notch 51, the third notch 81 and the fourth notch 71, so as to limit the live wire spring plate 5 and the neutral wire spring plate 7, allowing the live wire spring plate 5 and the live wire conductive plate 6 to contact with each other, as well as the neutral wire spring plate 7 and the neutral wire conductive plate 8 to contact with each other. In the abovementioned descriptions, the fact that the width W of the first notch 61 is larger than the width W' of the second notch 51, and the width W of the third notch 81 is larger than the width W' of the fourth notch 71 is to allow the first notch 61 and the third notch 81 to be provided with an enough space, without interfering with the movement of the destructed connecting element 3. In order to not interfere with the movement of the destructed connecting element 3, the abovementioned live wire conductive plate 6 and neutral wire conductive plate 8 can be also implemented as other configuration. For example, as shown in FIG. 3A, a live wire spring plate 5A and a live wire conductive plate 6A are limited from contacting with each other, as well as a neutral wire spring plate 7A and a neutral wire conductive plate 8A are limited from contacting with each other. The live wire spring plate 5A is formed with a first notch 51A, the neutral wire spring plate 7A is formed with a second notch 71A, and the live wire conductive plate 6A and the neutral wire conductive plate 8A should not be extended beyond the first notch 51A and the second notch 71A.

Figure 5:
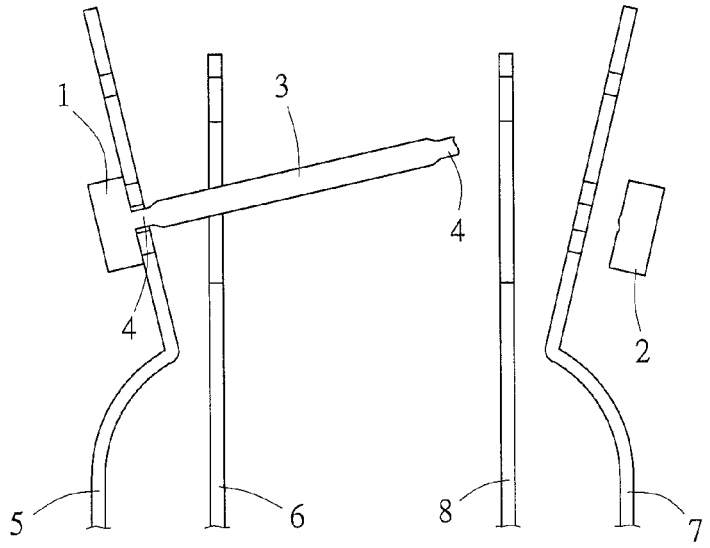
FIG. 5 shows a schematic view illustrating that the protective structure assuring a live wire and a neutral wire to be powered off simultaneously when overheating is destructed due to overheating, so that the live wire spring plate and the neutral wire spring plate can be tripped off, according to the first embodiment of the present invention.

Referring to FIG. 3 and FIG. 5, when a location between the live wire spring plate 5 and the live wire conductive plate 6 is overheated or a location between the neutral wire spring plate 7 and the neutral wire conductive plate 8 is overheated, if any one location in the first limiting element 1, the second limiting element 2 or the connecting element 3 is destructed, then the first limiting element 1, the second limiting element 2 and the connecting element 3 will all lose the original limiting function thereof, allowing the live wire spring plate 5, the live wire conductive plate 6, the neutral wire spring plate 7 and the neutral wire conductive plate 8 to be separated apart at a same time. For example, in the present embodiment, when overheating, the destructive portion 4 will be usually destructed. As the width W of the first notch 61 and the width W of the third notch 81 are larger, the destructed connecting element 3 will be provided with an enough space for movement, which assures that the live wire spring plate 5, the live wire conductive plate 6, the neutral wire spring plate 7 and the neutral wire conductive plate 8 can be separated apart at a same time.

Figure 6:
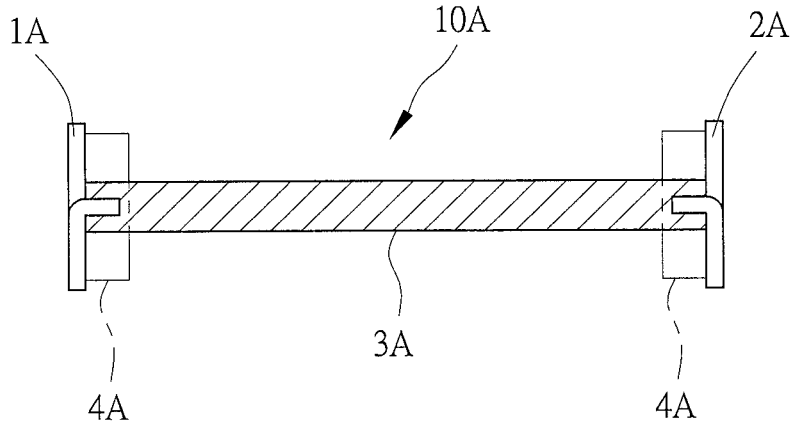
FIG. 6 shows a schematic view illustrating that the protective structure assuring a live wire and a neutral wire to be powered off simultaneously when overheating is made of metal combined with plastic, according to a second embodiment of the present invention.

Referring to FIG. 6 for the second embodiment of the present invention, the protective structure 10A assuring the live wire and the neutral wire to be powered off simultaneously when overheating, according to the present embodiment, comprises a first limiting element 1A, a second limiting element 2A and a connecting element 3A. The connecting element 3A is connected with the first limiting element 1A and the second limiting element 2A, forming an H-shaped structure to the protective structure 10A that assures the live wire and the neutral wire to be powered off simultaneously when overheating. The first limiting element 1A and the second limiting element 2A are made of metal, and the connecting element 3A is made of plastic. A destructive portion 4A is disposed between the connecting element 3A and the first limiting element 1A as well as between the connecting element 3A and the second limiting element 2A. In the present embodiment, heat can be transferred more uniformly and rapidly by the first limiting element 1A and the second limiting element 2A as they are made of metal, assuring that the abovementioned destructive portion 4A can be destructed when an open path is overheated.

Figure 7:
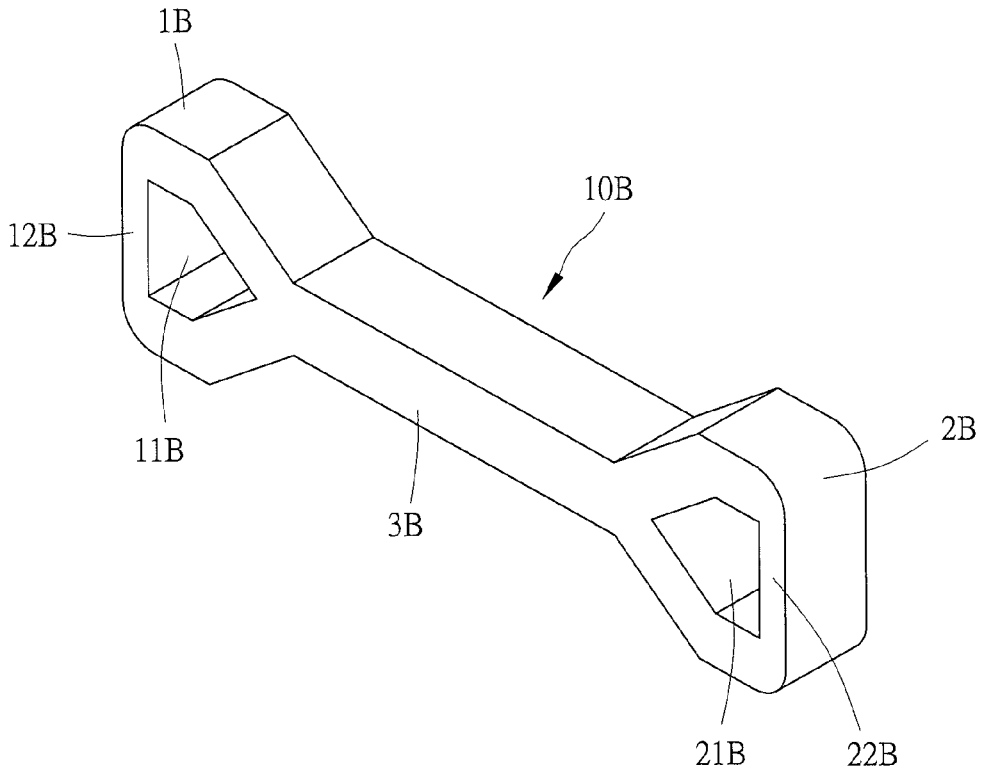
FIG. 7 shows a three-dimensional view of appearance of the protective structure assuring a live wire and a neutral wire to be powered off simultaneously when overheating, according to a third embodiment of the present invention.

Referring to FIG. 7 for the third embodiment of the present invention, the protective structure 10B assuring the live wire and the neutral wire to be powered off simultaneously when overheating, according to the present embodiment, comprises a first limiting element 1B, a second limiting element 2B and a connecting element 3B. The connecting element 3B is connected with the first limiting element 1B and the second limiting element 2B, the first limiting element 1B is formed with a first collar 11B and the second limiting element 2B is formed with a second collar 21B. In addition, part of the wall of the first collar 11B is thinner to form a first destructive portion 12B, and part of the wall of the second collar 21B is thinner to form a second destructive portion 22B.

Figure 8:
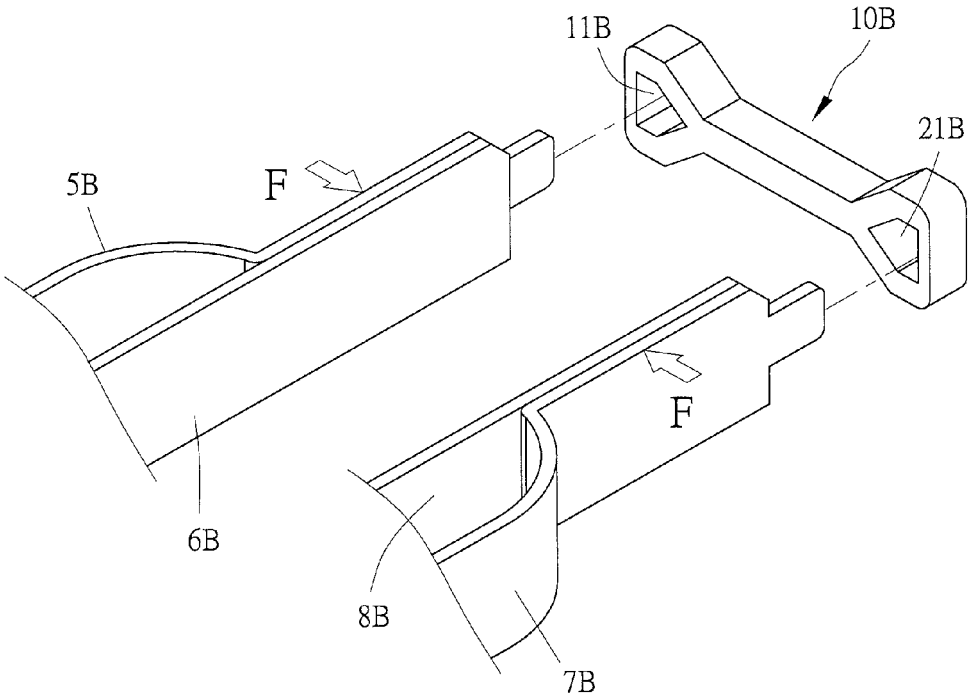
FIG. 8 shows an exploded view of combining the protective structure assuring a live wire and a neutral wire to be powered off simultaneously when overheating with the live wire spring plate and the neutral wire spring plate, according to the third embodiment of the present invention.
Figure 9:
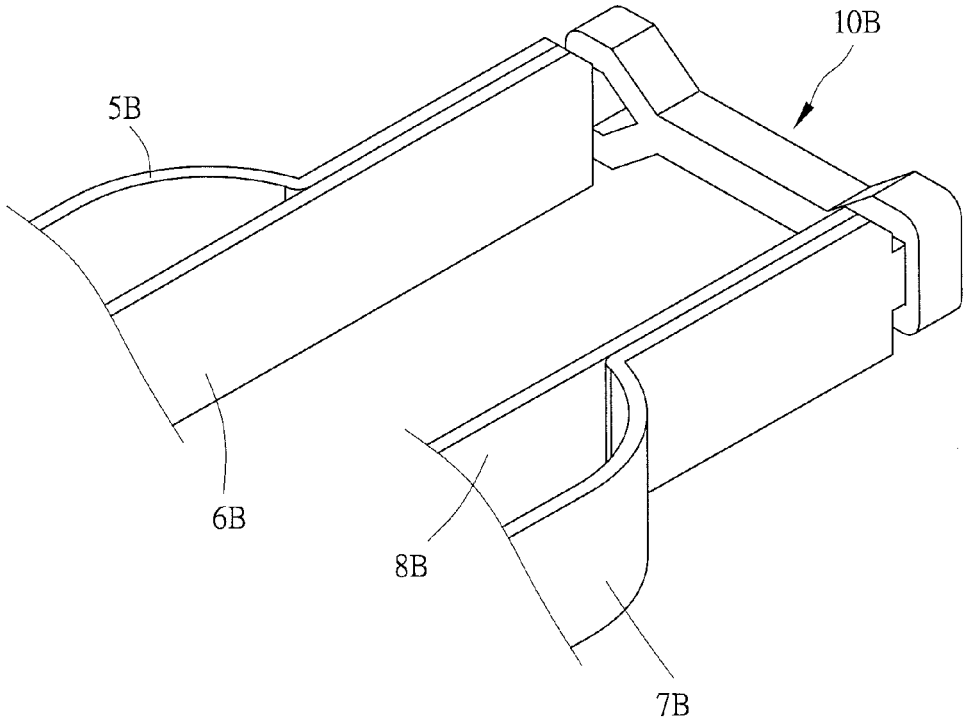
FIG. 9 shows a schematic view of combining the protective structure assuring a live wire and a neutral wire to be powered off simultaneously when overheating with the live wire spring plate and the neutral wire spring plate, according to the third embodiment of the present invention.

Referring to FIG. 8 and FIG. 9, there are a live wire spring plate 5B, a live wire conductive plate 6B, a neutral wire spring plate 7B and a neutral wire conductive plate 8B. An external force F is applied first to abut the live wire spring plate 5B at the live wire conductive plate 6B, and to abut the neutral wire spring plate 7B at the neutral wire conductive plate 8B. Next, the first collar 11B is sheathed on the live wire spring plate 5B, and the second collar 21B is sheathed on the neutral wire spring plate 7B, so as to limit the live wire spring plate 5B and the neutral wire spring plate 7B, allowing the live wire spring plate 5B and the live wire conductive plate 6B to contact with each other, as well as the neutral wire spring plate 7B and the neutral wire conductive plate 8B to contact with each other.

Figure 10:
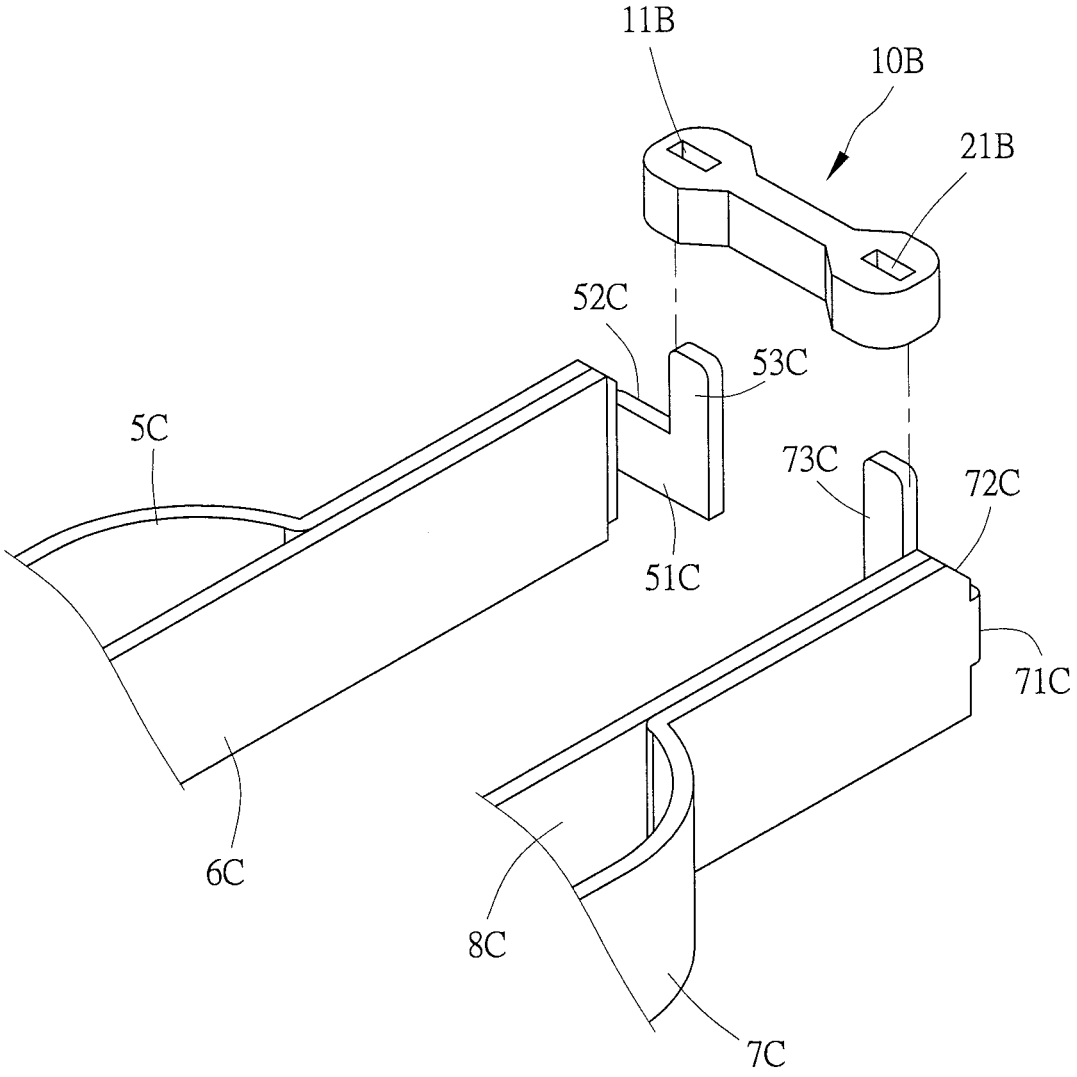
FIG. 10 shows an exploded view of combining the protective structure assuring a live wire and a neutral wire to be powered off simultaneously when overheating with the live wire spring plate and the neutral wire spring plate, according to a fourth embodiment of the present invention.
Figure 11:
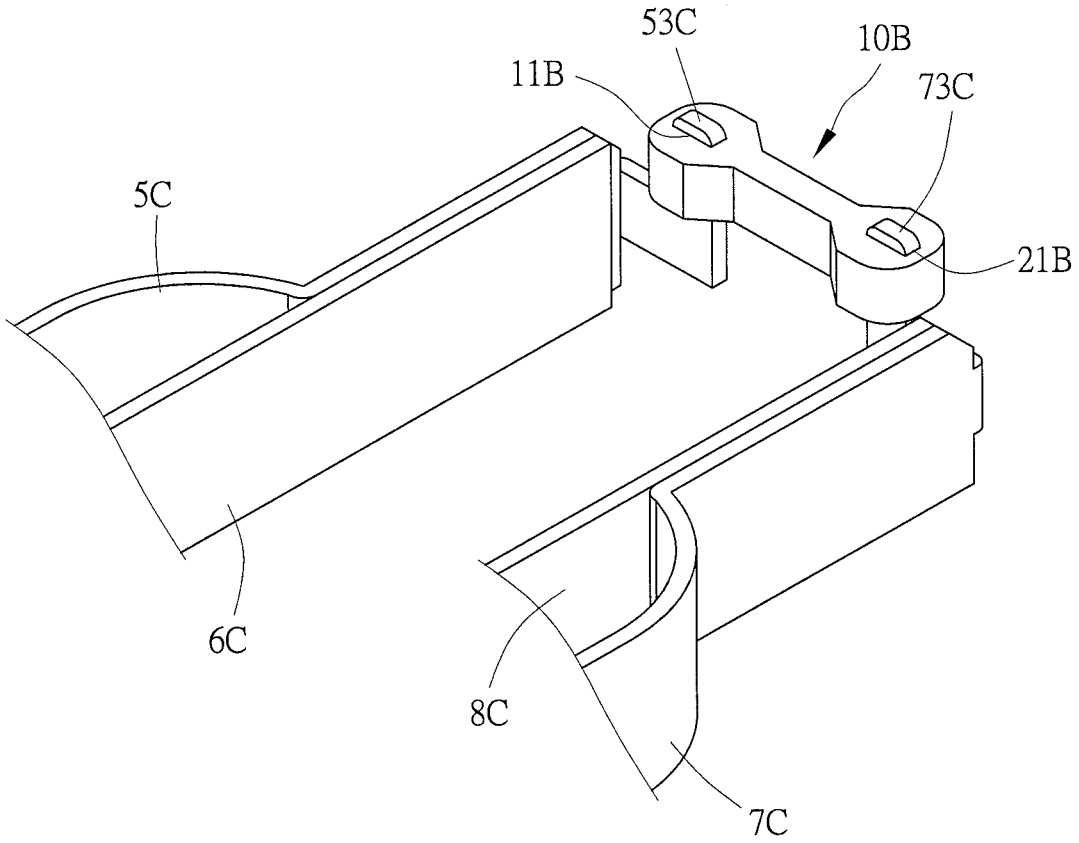
FIG. 11 shows a schematic view of combining the protective structure assuring a live wire and a neutral wire to be powered off simultaneously when overheating with the live wire spring plate and the neutral wire spring plate, according to the fourth embodiment of the present invention.
Figure 12:
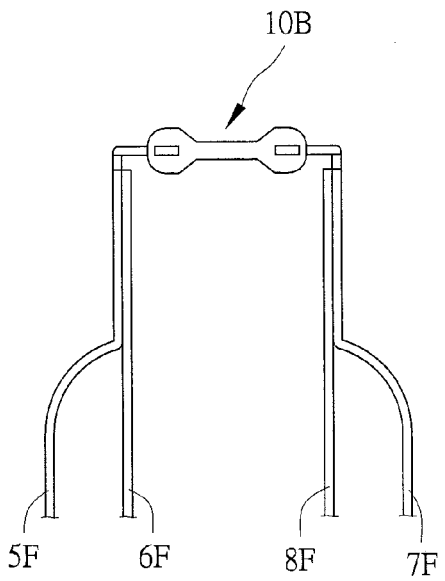
FIG. 12 shows a schematic view of combining the protective structure assuring a live wire and a neutral wire to be powered off simultaneously when overheating with the live wire spring plate and the neutral wire spring plate in a different configuration, according to the fourth embodiment of the present invention.
Figure 13:
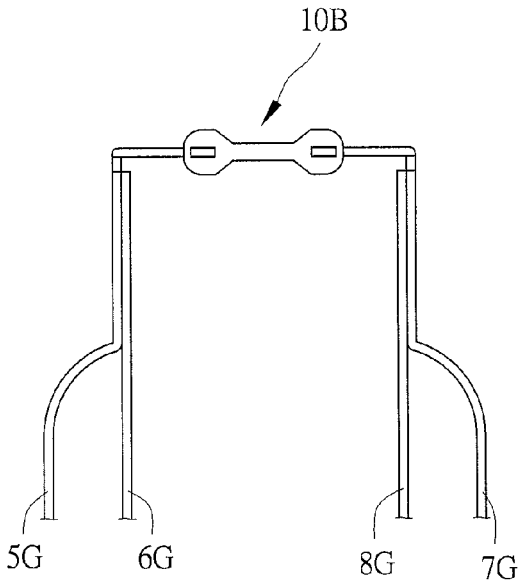
FIG. 13 shows a schematic view of combining the protective structure assuring a live wire and a neutral wire to be powered off simultaneously when overheating with the live wire spring plate and the neutral wire spring plate in a different configuration, according to the fourth embodiment of the present invention.

Referring to FIG. 10 and FIG. 11 for the fourth embodiment of the present invention, the fourth embodiment is changed from the third embodiment. Differing from the third embodiment, the present embodiment discloses a live wire spring plate 5C, a live wire conductive plate 6C, a neutral wire spring plate 7C and a neutral wire conductive plate 8C. The live wire spring plate 5C is formed with a first bending portion 51C on which is provided with a first groove 52C, so as to form a first sheathing section 53C on the first bending portion 51C, allowing the first collar 11B to be sheathed on the first sheathing section 53C. The neutral wire spring plate 7C is formed with a second bending portion 71C on which is provided with a second groove 72C, so as to form a second sheathing section 73C on the second bending portion 71C, allowing the second collar 21B to be sheathed on the second sheathing section 73C. Referring to FIG. 12 and FIG. 13, therefore, only one size is needed for the protective structure 10B assuring the live wire and the neutral wire to be powered off simultaneously when overheating, according to the present embodiment, to apply to various live wire spring plates 5F, 5G, live wire conductive plates 6F, 6G, neutral wire spring plates 7F, 7G and neutral wire conductive plates 8F, 8G.

Figure 14:
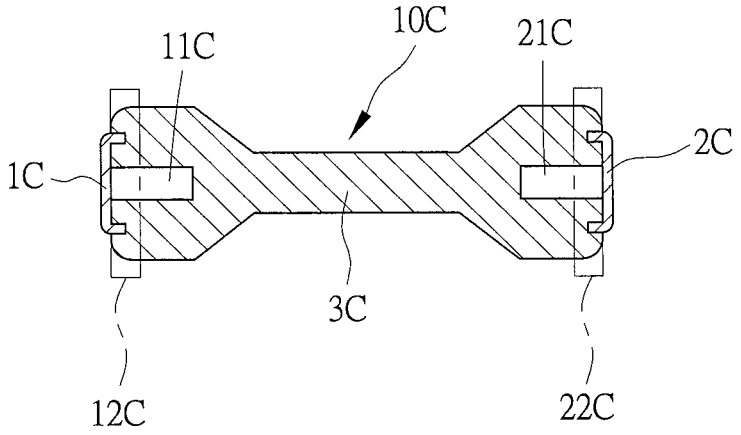
FIG. 14 shows a schematic view illustrating that the protective structure assuring a live wire and a neutral wire to be powered off simultaneously when overheating is made of metal combined with plastic, according to a fifth embodiment of the present invention.

Referring to FIG. 14 for the fifth embodiment of the present invention, the protective structure 10C assuring the live wire and the neutral wire to be powered off simultaneously when overheating, according to the present embodiment, comprises a first limiting element 1C, a second limiting element 2C and a connecting element 3C. The connecting element 3C is connected with the first limiting element 10 and the second limiting element 2C, a first collar 11C is formed between the first limiting element 1C and the connecting element 3C, and a second collar 21C is formed between the second limiting element 2C and the connecting element 3C. The first limiting element 1C and the second limiting element 2C are made of metal, and the connecting element 3C is made of plastic. A first destructive portion 12C is disposed between the connecting element 3C and the first limiting element 1C, and a second destructive portion 22C is disposed between the connecting element 3C and the second limiting element 2C. In the present embodiment, heat can be also transferred more uniformly and rapidly by the first limiting element 1C and the second limiting element 2C as they are made of metal, which assures that when an open path is overheated, the abovementioned first destructive portion 12C and second destructive portion 22C can be destructed.

Figure 15:
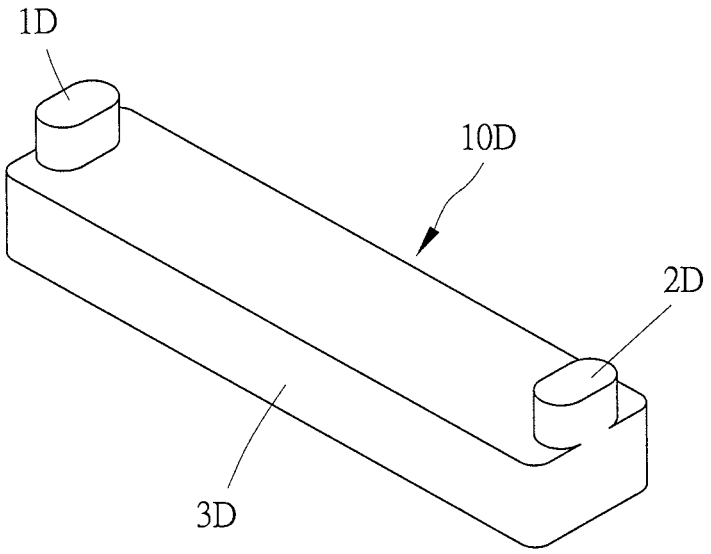
FIG. 15 shows a three-dimensional view of appearance of the protective structure assuring a live wire and a neutral wire to be powered off simultaneously when overheating, according to a sixth embodiment of the present invention.

Referring to FIG. 15 for the sixth embodiment of the present invention, the protective structure 10D assuring the live wire and the neutral wire to be powered off simultaneously when overheating, according to the present embodiment, comprises a first limiting element 1D, a second limiting element 2D and a connecting element 3D. The connecting element 3D is connected with the first limiting element 1D and the second limiting element 2D. The first limiting element 1D and the second limiting element 2D are in a shape of bumps which are formed respectively at two opposite ends of the connecting element 3D.

Figure 16:
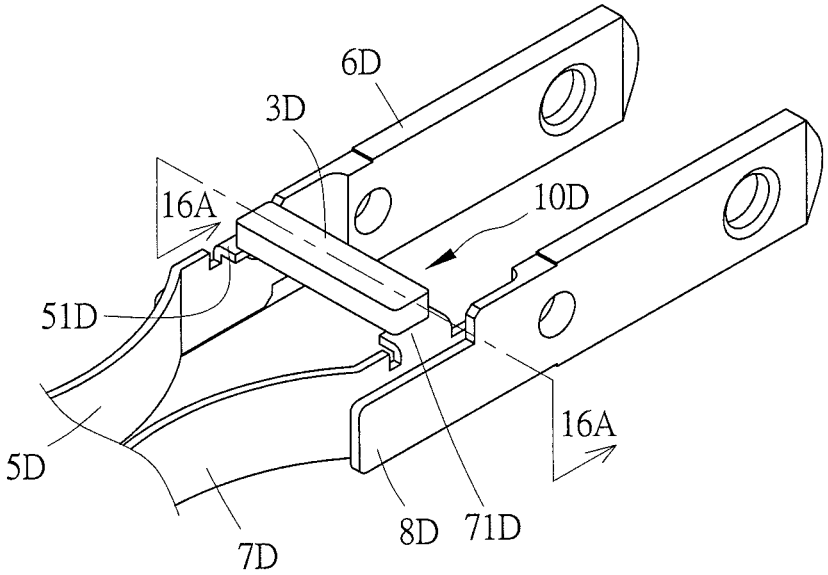
FIG. 16 shows a schematic view illustrating that the protective structure assuring a live wire and a neutral wire to be powered off simultaneously when overheating abuts outward at the live wire spring plate and the neutral wire spring plate, according to the sixth embodiment of the present invention.
Figure 16A:
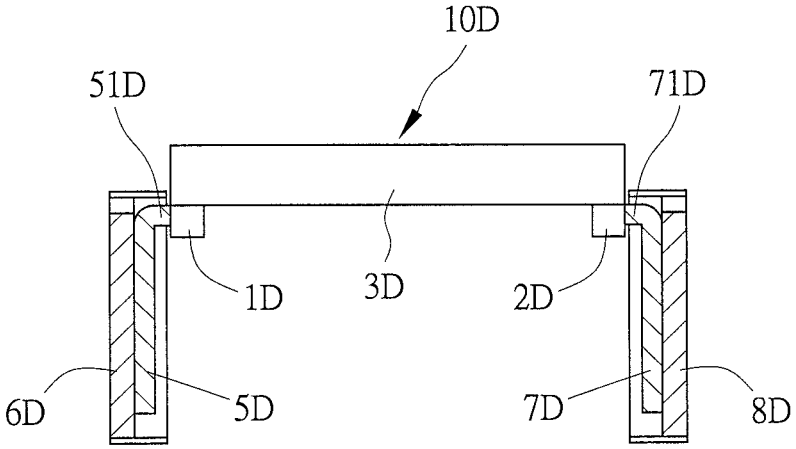
FIG. 16A is a cutaway view of FIG. 16.
Figure 17:
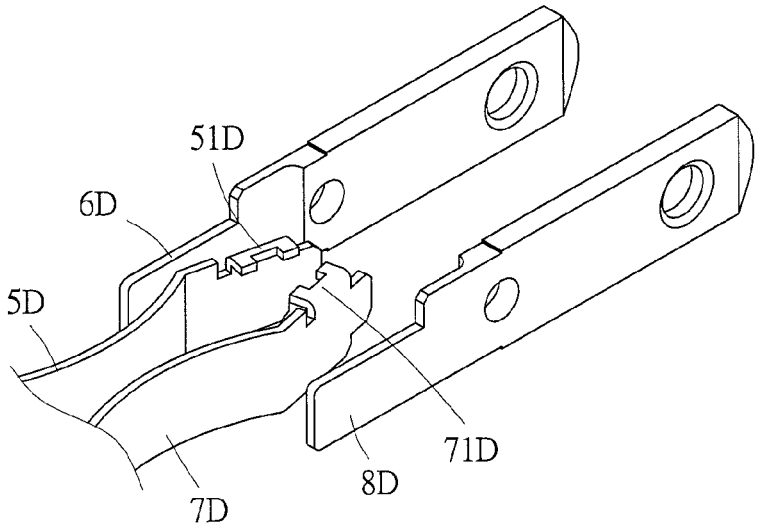
FIG. 17 shows a schematic view illustrating that when the protective structure assuring a live wire and a neutral wire to be powered off simultaneously when overheating is destructed, an elastic force will enable the live wire spring plate and the neutral wire spring plate to displace inward relative to each other, according to the sixth embodiment of the present invention.

Referring to FIG. 16, FIG. 16A and FIG. 17, the present embodiment further discloses a live wire spring plate 5D, a live wire conductive plate 6D, a neutral wire spring plate 7D and a neutral wire conductive plate 8D. The live wire spring plate 5D is formed with a first abutting portion 51D and the neutral wire spring plate 7D is formed with a second abutting portion 71D. The first limiting element 1D and the second limiting element 2D abut respectively outward at the first abutting portion 51D and the second abutting portion 71D, allowing the live wire spring plate 5D and the live wire conductive plate 6D to contact with each other, as well as the neutral wire spring plate 7D and the neutral wire conductive plate 8D to contact with each other. When any location in the first limiting element 1D, the second limiting element 2D or the connecting element 3D is destructed, an elastic force will enable the live wire spring plate 5D and the neutral wire spring plate 7D to displace inward relative to each other.

Figure 18:
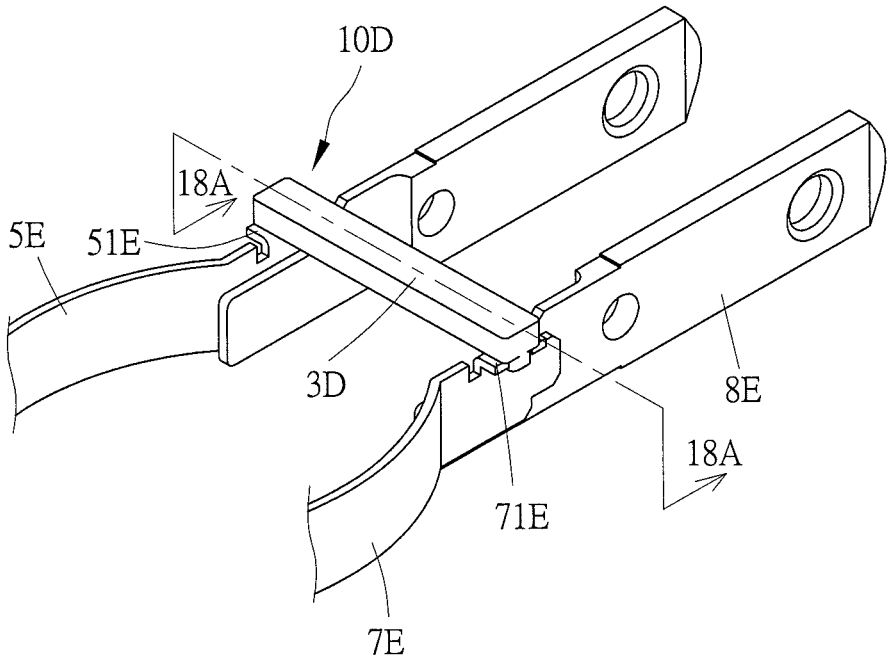
FIG. 18 shows a schematic view illustrating that the protective structure assuring a live wire and a neutral wire to be powered off simultaneously when overheating abuts inward at the live wire spring plate and the neutral wire spring plate, according to the sixth embodiment of the present invention.
Figure 18A:
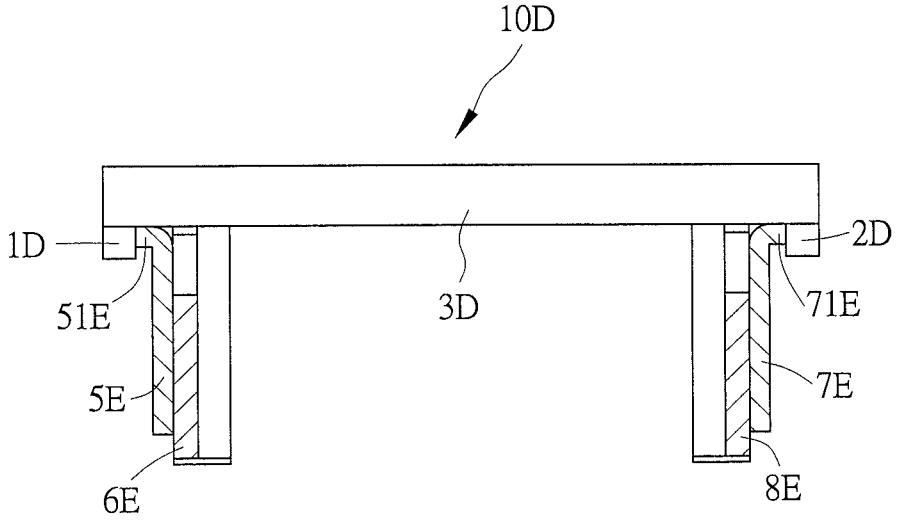
FIG. 18A is a cutaway view of FIG. 18.
Figure 19:
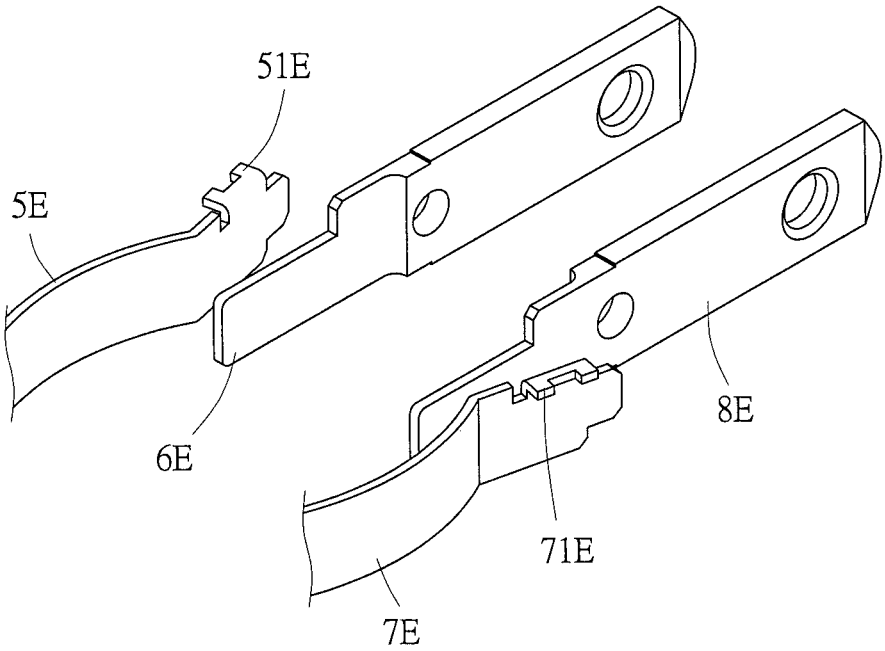
FIG. 19 shows a schematic view illustrating that when the protective structure assuring a live wire and a neutral wire to be powered off simultaneously when overheating is destructed, an elastic force will enable the live wire spring plate and the neutral wire spring plate to displace outward relative to each other, according to the sixth embodiment of the present invention.

Referring to FIG. 18, FIG. 18A and FIG. 19, the present embodiment further discloses a live wire spring plate 5E, a live wire conductive plate 6E, a neutral wire spring plate 7E and a neutral wire conductive plate 8E. The live wire spring plate 5E is formed with a first abutting portion 51E, and the neutral wire spring plate 7E is formed with a second abutting portion 71E. The first limiting element 1D and the second limiting element 2D abut respectively inward at the first abutting portion 51E and the second abutting portion 71E, allowing the live wire spring plate 5E and the live wire conductive plate 6E to contact with each other, as well as the neutral wire spring plate 7E and the neutral wire conductive plate 8E to contact with each other. When any one location in the first limiting element 1D, the second limiting element 2D or the connecting element 3D is destructed, an elastic force will enable the live wire spring plate 5E and the neutral wire spring plate 7E to displace outward relative to each other.

Figure 20:
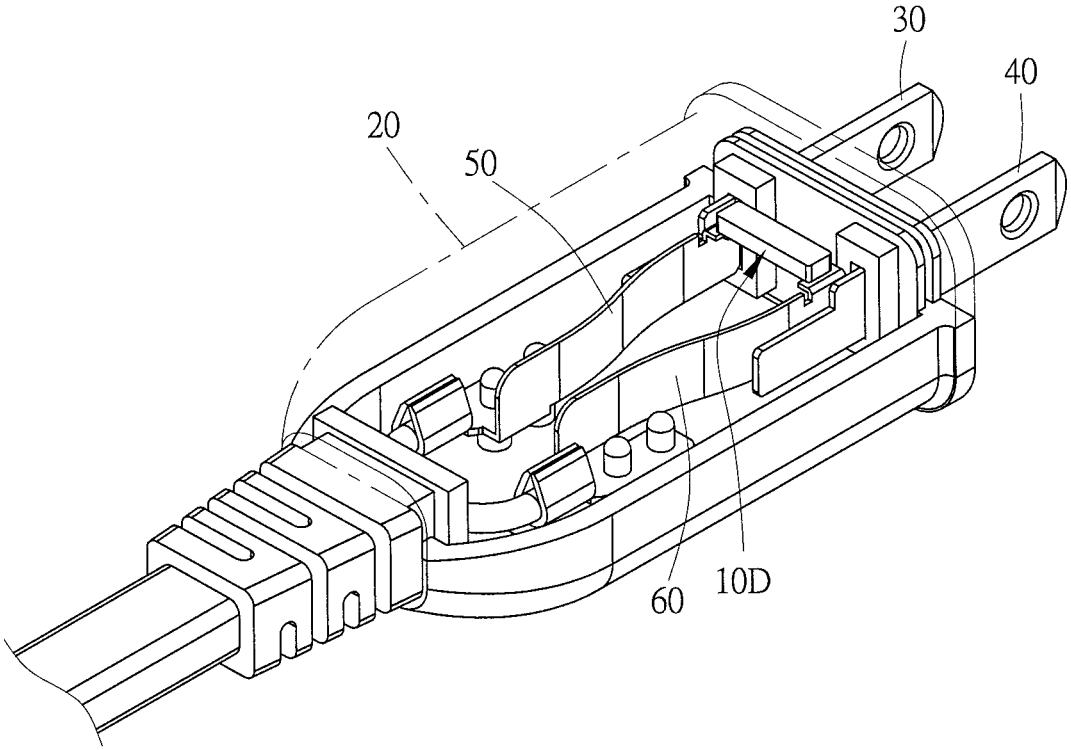
FIG. 20 shows a schematic view illustrating that the protective structure assuring a live wire and a neutral wire to be powered off simultaneously when overheating is applied to a plug, according to the present invention.

Referring to FIG. 20, the protective structure 10D assuring the live wire and the neutral wire to be powered off simultaneously when overheating, according to the sixth embodiment, is taken as an example for use in overheat protection for a plug. The plug of the present embodiment comprises an insulative unit 20; a live wire conductive plate 30, which is provided in the insulative unit 20 and is extended out of the insulative unit 20; a neutral wire conductive plate 40, which is provided in the insulative unit 20 and is extended out of the insulative unit 20; a live wire spring plate 50, which is provided in the insulative unit 20 and corresponds to the live wire conductive plate 30; and a neutral wire spring plate 60, which is provided in the insulative unit 20 and corresponds to the neutral wire conductive plate 40. When the protective structure 10D assuring the live wire and the neutral wire to be powered off simultaneously when overheating is used to limit and fix the live wire spring plate 50 and the neutral wire spring plate 60, if a location between the live wire spring plate 50 and the live wire conductive plate 30 is overheated or a location between the neutral wire spring plate 60 and the neutral wire conductive plate 40 is overheated, then the protective structure 10D assuring the live wire and the neutral wire to be powered off simultaneously when overheating will be assured to lose the original limiting function thereof, allowing the live wire spring plate 50, the live wire conductive plate 30, the neutral wire spring plate 60 and the neutral wire conductive plate 40 to be separated apart at a same time.

Figure 21:
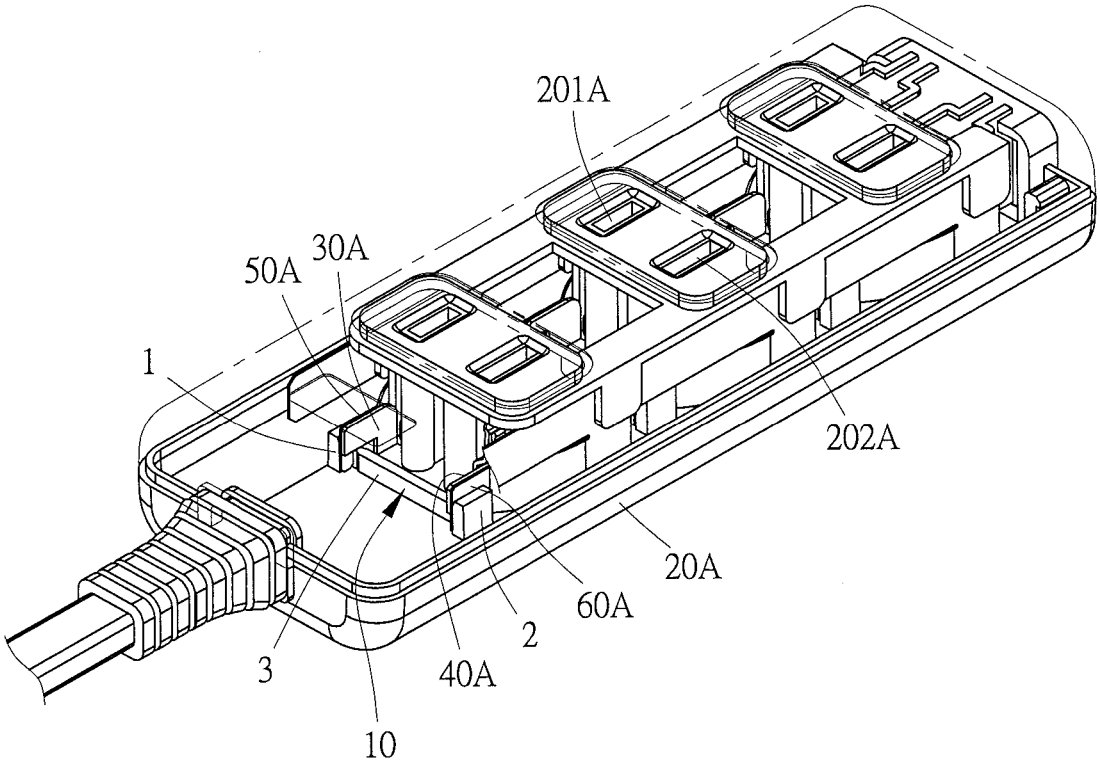
FIG. 21 shows a schematic view illustrating that the protective structure assuring a live wire and a neutral wire to be powered off simultaneously when overheating is applied to a socket, according to the present invention.

Referring to FIG. 21, the protective structure 10 assuring the live wire and the neutral wire to be powered off simultaneously when overheating, according to the first embodiment, is taken as an example for use in overheat protection for a plug. The plug of the present embodiment comprises an insulative unit 20A, which is provided at least with a live wire receptacle 201A and an opposite neutral wire receptacle 202A; a live wire conductive plate 30A, which is installed in the insulative unit 20A and corresponds to the live wire receptacle 201A; a neutral wire conductive plate 40A, which is installed in the insulative unit 20A and corresponds to the neutral wire receptacle 202A; a live wire spring plate 50A, which is installed in the insulative unit 20A and corresponds to the live wire conductive plate 30A; and a neutral wire spring plate 60A, which is installed in the insulative unit 20A and corresponds to the neutral wire conductive plate 40A. When the protective structure 10 assuring the live wire and the neutral wire to be powered off simultaneously when overheating is used to limit and fix the live wire spring plate 50A and the neutral wire spring plate 60A, as disclosed in the first embodiment, if a location between the live wire spring plate 50A and the live wire conductive plate 30A is overheated or a location between the neutral wire spring plate 60A and the neutral wire conductive plate 40A is overheated, then as long as any one location in the first limiting element 1, the second limiting element 2 or the connecting element 3 is destructed, the first limiting element 1, the second limiting element 2 and the connecting element 3 will all lose the original limiting function thereof, allowing the live wire spring plate 50A, the live wire conductive plate 30A, the neutral wire spring plate 60A and the neutral wire conductive plate 40A to be separated apart at a same time.

Figure 22:
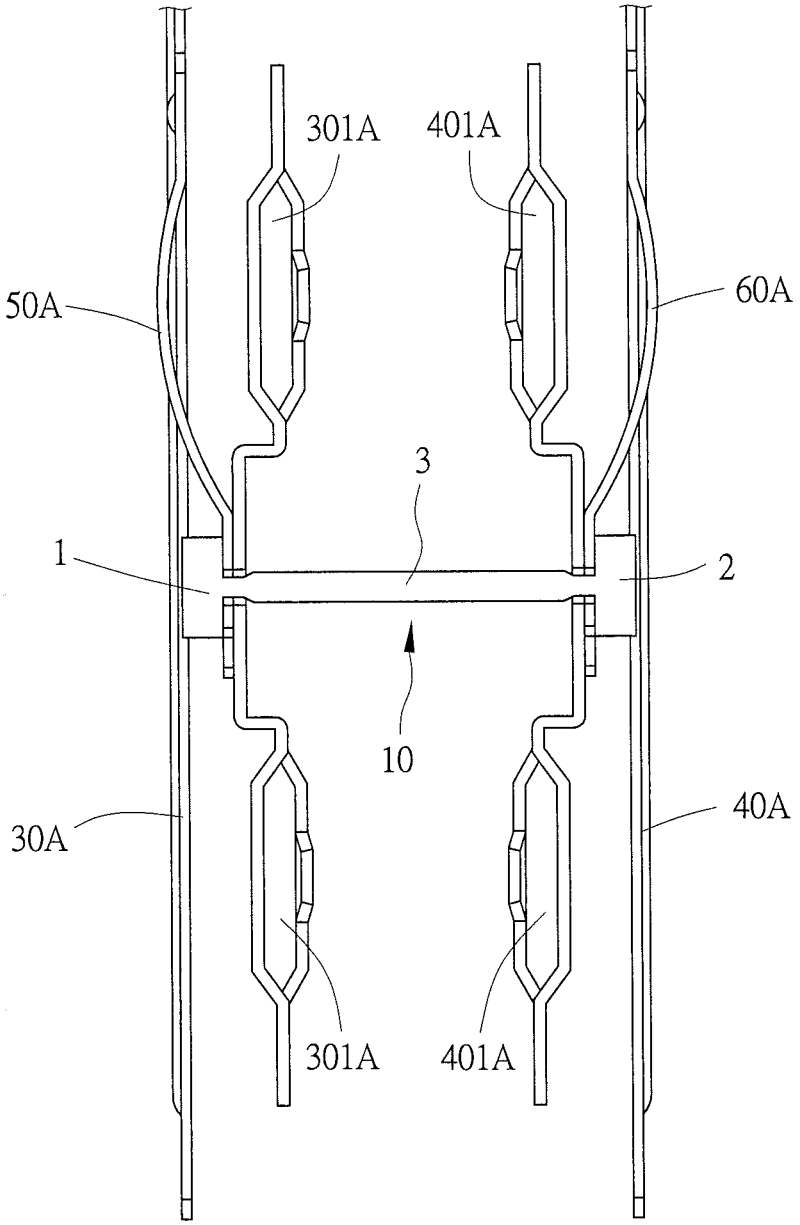
FIG. 22 shows a schematic view illustrating that the protective structure assuring a live wire and a neutral wire to be powered off simultaneously when overheating is used to protect plural conductive slots at a same time, according to the present invention.

Referring to FIG. 22, it shows a variation in the abovementioned socket, wherein the live wire conductive plate 30A includes plural live wire slots 301A opposite to the abovementioned live wire receptacle 201A (as shown in FIG. 21), and the live wire conductive plate 30A contacts with one single live wire spring plate 50A; whereas, the neutral wire conductive plate 40A includes plural neutral wire slots 401A opposite to the abovementioned neutral wire receptacle 202A (as shown in FIG. 21), and the neutral wire conductive plate 40A contacts with one single neutral wire spring plate 60A. Under a normal condition, the live wire conductive plate 30A, the live wire spring plate 50A, the neutral wire conductive plate 40A and the neutral wire conductive plate 60A are commonly limited by the first limiting element 1, the second limiting element 2 and the connecting element 3. Accordingly, by this configuration, a single protective structure 10 assuring the live wire and the neutral wire to be powered off simultaneously when overheating can be used to carry out overheat protection for plural live wire slots 301A and plural neutral wire slots 401A.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A protective structure assuring a live wire and a neutral wire to be powered off simultaneously when overheating, being used to limit a live wire spring plate and a live wire conductive plate from contacting with each other, as well as a neutral wire spring plate and a neutral wire conductive plate from contacting with each other, with the protective structure assuring a live wire and a neutral wire to be powered off simultaneously when overheating comprising:

a first limiting element, a second limiting element and a connecting element, wherein the connecting element is connected with the first limiting element and the second limiting element, the first limiting element and the second limiting element abut respectively at the live wire spring plate and the neutral wire spring plate, and the connecting element limits the live wire spring plate and the neutral wire spring plate, allowing the live wire spring plate and the live wire conductive plate to contact with each other, as well as the neutral wire spring plate and the neutral wire conductive plate to contact with each other; when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element all lose the original limiting function thereof, allowing the live wire spring plate, the live wire conductive plate, the neutral wire spring plate and the neutral wire conductive plate to be separated apart at a same time.

2. The protective structure assuring a live wire and a neutral wire to be powered off simultaneously when overheating, according to claim 1, wherein the first limiting element, the second limiting element and the connecting element are all made of plastic, the first limiting element and the second limiting element are in a plate shape, a destructive portion is disposed between the connecting element and the first limiting element as well as between the connecting element and the second limiting element, and thickness of the destructive portion is smaller than thickness of the connecting element.

3. The protective structure assuring a live wire and a neutral wire to be powered off simultaneously when overheating, according to claim 1, wherein the first limiting element and the second limiting element are made of metal, the connecting element is made of plastic, and a destructive portion is disposed between the connecting element and the first limiting element as well as between the connecting element and the second limiting element.

4. The protective structure assuring a live wire and a neutral wire to be powered off simultaneously when overheating, according to claim 1, wherein the first limiting element and the second limiting element are in a shape of bumps which are formed respectively at two opposite ends of the connecting element.

5. The protective structure assuring a live wire and a neutral wire to be powered off simultaneously when overheating, according to claim 1, wherein the live wire conductive plate is formed with a first notch, the live wire spring plate is formed with a second notch, the neutral wire conductive plate is formed with a third notch, and the neutral wire spring plate is formed with a fourth notch; whereas, the first notch, the second notch, the third notch and the fourth notch are used to accommodate the connecting element, with that a width of the first notch is larger than a width of the second notch, and a width of the third notch is larger than a width of the fourth notch.

6. The protective structure assuring a live wire and a neutral wire to be powered off simultaneously when overheating, according to claim 1, wherein the first limiting element is formed with a first collar to sheath the live wire spring plate, and the second limiting element is formed with a second collar to sheath the neutral wire spring plate.

7. The protective structure assuring a live wire and a neutral wire to be powered off simultaneously when overheating, according to claim 6, wherein part of a wall of the first collar is thinner to form a first destructive portion, and part of a wall of the second collar is thinner to form a second destructive portion.

8. The protective structure assuring a live wire and a neutral wire to be powered off simultaneously when overheating, according to claim 6, wherein the live wire spring plate is formed with a first bending portion on which is provided with a first groove, so as to form a first sheathing section on the first bending portion, allowing the first collar to be sheathed on the first sheathing section; and the neutral wire spring plate is formed with a second bending portion on which is provided with a second groove, so as to form a second sheathing section on the second bending portion, allowing the second collar to be sheathed on the second sheathing section.

9. The protective structure assuring a live wire and a neutral wire to be powered off simultaneously when overheating, according to claim 1, wherein the live wire conductive plate includes plural live wire slots, the live wire conductive plate contacts with one single live wire spring plate, the neutral wire conductive plate includes plural neutral wire slots, the neutral wire conductive plate contacts with one single neutral wire spring plate, and the live wire conductive plate, the live wire spring plate, the neutral wire conductive plate and the neutral wire spring plate are commonly limited by the first limiting element, the second limiting element and the connecting element, under a normal condition.

10. A socket using the protective structure assuring a live wire and a neutral wire to be powered off simultaneously when overheating, according to claim 1, comprising:

an insulative unit, which is provided with a live wire receptacle and an opposite neutral wire receptacle;

a live wire conductive plate, which is installed in the insulative unit and corresponds to the live wire receptacle;

a neutral wire conductive plate, which is installed in the insulation unit and corresponds to the neutral wire receptacle;

a live wire spring plate, which is installed in the insulative unit and corresponds to the live wire conductive plate; and a neutral wire spring plate, which is installed in the insulative unit and corresponds to the neutral wire conductive plate;

wherein by abutting the first limiting element and the second limiting element of the protective structure, which assures a live wire and a neutral wire to be powered off simultaneously when overheating, at the live wire spring plate and the neutral wire spring plate respectively, and by using the connecting element to limit the live wire spring plate and the neutral wire spring plate, the live wire spring plate and the live wire conductive plate contact with each other, as well as the neutral wire spring plate and the neutral wire conductive plate contact with each other; and when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element all lose the original limiting function thereof, allowing the live wire spring plate, the live wire conductive plate, the neutral wire spring plate and the neutral wire conductive plate to be separated apart at a same time.

11. A plug using the protective structure assuring a live wire and a neutral wire to be powered off simultaneously when overheating, according to claim 1, comprising:

an insulative unit;

a live wire conductive plate, which is disposed in the insulative unit and is extended out of the insulative unit;

a neutral wire conductive plate, which is disposed in the insulative unit and is extended out of the insulative unit;

a live wire spring plate, which is disposed in the insulative unit and corresponds to the live wire conductive plate; and a neutral wire spring plate, which is disposed in the insulative unit and corresponds to the neutral wire conductive plate;

wherein by abutting the first limiting element and the second limiting element of the protective structure, which assures a live wire and a neutral wire to be powered off simultaneously when overheating, at the live wire spring plate and the neutral wire spring plate respectively, and by using the connecting element to limit the live wire spring plate and the neutral wire spring plate, the live wire spring plate and the live wire conductive plate contact with each other, as well as the neutral wire spring plate and the neutral wire conductive plate contact with each other; and when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element all lose the original limiting function thereof, allowing the live wire spring plate, the live wire conductive plate, the neutral wire spring plate and the neutral wire conductive plate to be separated apart at a same time.

12. A method assuring a live wire and a neutral wire to be powered off simultaneously when overheating, comprising:

abutting a first limiting element and a second limiting element at a live wire spring plate and a neutral wire spring plate respectively, and using a connecting element to connect the first limiting element and the second limiting element, allowing the connecting element to limit the live wire spring plate and the neutral wire spring plate, such that the live wire spring plate and the live wire conductive plate contact with each other, as well as the neutral wire spring plate and the neutral wire conductive plate contact with each other, under a normal condition; and selecting a thermal destructive material for the first limiting element, the second limiting element or the connecting element, with the thermal destructive material being allowed to be destructed at a temperature of 80° C.-299° C., such that when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element all lose the original limiting function thereof, allowing the live wire spring plate, the live wire conductive plate, the neutral wire spring plate and the neutral wire conductive plate to be separated apart at a same time.

* * * * *